United States Patent [19]

Watanabe

[11] Patent Number: 4,512,874

[45] Date of Patent: Apr. 23, 1985

[54] METHOD FOR PRODUCING MESOPHASE CONTINUOUSLY

[75] Inventor: Masami Watanabe, Tokyo, Japan

[73] Assignee: Kashima Oil Company Limited, Tokyo, Japan

[21] Appl. No.: 507,587

[22] Filed: Jun. 24, 1983

[51] Int. Cl.[3] ..... C10C 3/00; D01F 9/14

[52] U.S. Cl. ..... 208/44; 208/39; 208/40; 208/22

[58] Field of Search ..... 208/44, 40, 39, 22

[56] References Cited

U.S. PATENT DOCUMENTS

| | | | |
|---|---|---|---|
| 3,928,170 | 12/1975 | Takahashi | 208/40 |
| 3,974,264 | 8/1976 | McHenry | 423/447.4 |
| 3,976,729 | 8/1976 | Lewis et al. | 423/447.6 |
| 4,005,183 | 1/1977 | Singer | 208/44 |
| 4,026,788 | 5/1977 | McHenry | 208/40 |
| 4,032,430 | 6/1977 | Lewis | 423/447.1 |
| 4,209,500 | 6/1980 | Chwastiak | 208/44 |
| 4,303,631 | 12/1981 | Lewis et al. | 423/447.1 |
| 4,317,809 | 3/1982 | Lewis et al. | 208/39 |

FOREIGN PATENT DOCUMENTS

| | | | |
|---|---|---|---|
| 0044714 | 1/1981 | European Pat. Off. | 208/44 |
| 0027739 | 4/1981 | European Pat. Off. | 208/44 |
| 102690 | 8/1980 | Japan | 208/40 |
| 47385 | 3/1982 | Japan | 423/447.2 |
| 2099845 | 12/1982 | United Kingdom | 208/22 |

*Primary Examiner*—Delbert E. Gantz
*Assistant Examiner*—Helane Myers
*Attorney, Agent, or Firm*—Armstrong, Nikaido, Marmelstein & Kubovcik

[57] ABSTRACT

A method for producing continuously 100% mesophase composed only of Q.I. component and Q.S. component in which a raw material of petroleum origin pitch is subjected continuously to a heat-treatment step in an amount necessary to produce a 100% mesophase taken out from a mesophase-growing and coalescing step, transferring the heat-formed pitch formed in the heat treatment step to a mesophase growing and coalescing step, taking out a definite amount of a non-mesophase pitch from the mesophase growing and coalescing step after stirring and heating treatment to return it to the heat-treatment step to repeat the stirring and heating treatment, and at the same time to take out 100% mesophase having constant properties from the mesophase growing and coalescing step.

1 Claim, 1 Drawing Figure

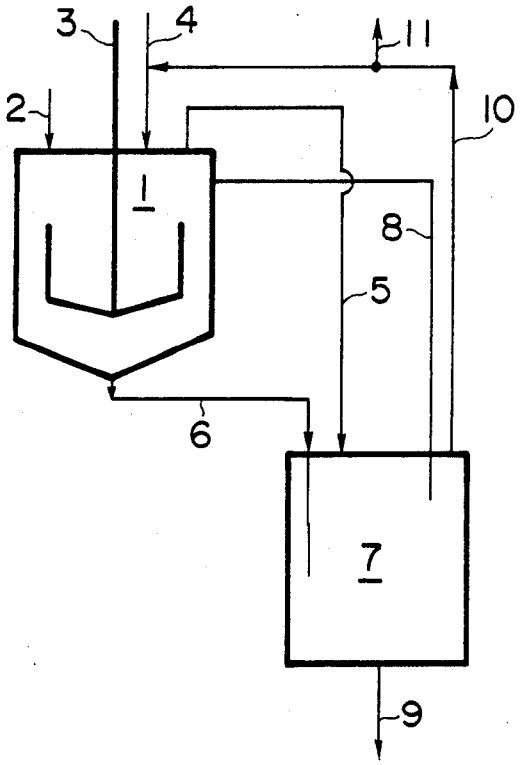
3
4
11
2
10
1
8
5
6
7
9

METHOD FOR PRODUCING MESOPHASE CONTINUOUSLY

This invention relates to a method for producing 100% mesophase pitch composed only of Q.I. and Q.S. components, as a raw material for high strength, high modulus carbon fibers. More particularly, it relates to a method for producing a 100% mesophase pitch composed only of Q.I. and Q.S. components, which enables us to produce with a high efficiency and at a low price, high strength, high modulus carbon fibers which are preferable as a raw material for composite articles.

BACKGROUND OF THE INVENTION

As the result of recent rapid growth of industries for manufacturing aircrafts, motor vehicles and other transport, the demand for materials capable of exhibiting remarkable characteristics because of the superiority of some of their physical properties is ever increasing. Particularly, the demand for the advent of inexpensive materials provided with high strength and high modulus together with lightness of weight is great. However, since the material which satisfies the above-mentioned demand cannot be supplied in a stabilized manner according to the present status of art, research works relative to composite articles (reinforced resins) which meet the above-mentioned requirement are prevailing.

As one of the most promising material to be used as reinforced resin, there can be mentioned high strength high modulus carbon fibers. These materials have appeared from about the time when the rapid growth of the above-mentioned industry just started. When the carbon fibers are combined with a resin, it is possible to produce reinforced resins capable of exhibiting characteristic features unparalleled in the past. However, in spite of the high strength and high modulus of the carbon fibers for the above-mentioned reinforced resins capable of exhibiting extremely notable characteristic features, the application fields of these fibers have not expanded. The cause of this fact, as explained later, lies in the higher production cost.

It is well known that the material for high strength high modulus carbon fibers which are commercially available are mostly polyacrylonitrile fibers produced by a special production process and a special spinning process, but these acrylonitrile fibers are not only expensive as a raw material, but also the production yield thereof from these raw material is as low as less than 45%. These facts complicate the treatment steps and enlarge production facility for producing superior carbon fibers, resulting in the increasing production cost of the ultimate products of carbon fibers.

As for the methods for producing inexpensive raw materials for carbon fibers, there are many reports such as U.S. Pat. No. 3,974,264 and U.S. Pat. No. 4,026,788 both issued to E. R. McHenry and assigned to Union Carbide Corporation, etc. Beside these, there are many reports in the official gazettes of patent publications. According to these methods, petroleum origin pitch or tar-origin pitch is subjected to heat treatment at a temperature of 380° C. to 440° C. to produce a pitch containing 40% to 90%, preferably 50% to 65% mesophase and resulting products are used, as they are, for raw materials for carbon fibers. Accordingly, these products contain a large amount of non-mesophase pitch and cannot be called a 100% mesophase pitch which is required as a raw material for high strength, high modulus carbon fibers and is not provided with the characteristic properties of 100% mesophase pitch.

Further, this production method of pitch is a batch process and on this account, properties of heat-formed pitch are not stabilized and the production method itself cannot be said to be a rational and commercial method.

Further, there is a method which is directed to the production of a mesophase, claiming to be essentially 100% mesophase, in the Official Gazette of Japanese laid open patent No. 55625 of 1979. According to this method, inert gas such as nitrogen, argon, xenon, helium, steam, etc. in a very large amount e.g. at least 8 l per kg raw material per minutes is introduced under pressure into isotropic pitch, which is then subjected to heat treatment at a temperature of 380° C. to 430° C., with vigorous stirring even for 5 to 44 hours, until it is converted into a single phase system. Thus, an attempt is made to produce a so-called 100% mesophase pitch. However, the isotropic pitch of raw material is of a so-called huge molecule, complicated and not a pure compound. It contains impurities and forms emulsion. Regardless of how long an inert gas is compressed into and no matter how vigorous stirring treatment is applied to the pitch, it is impossible to simplify the emulsion completely. In any event, it is impossible to avoid the mixing of non-reacted isotropic pitch, completely and resulting product cannot be said to be 100% mesophase.

It is an object of the present invention to provide a method for producing an inexpensive raw material for producing carbon fibers having constant properties, continuously on a commercial scale.

The above-mentioned object can be attained according to the method of the present invention in which an extremely inexpensive petroleum-origin pitch treated in two separate treating steps consisting of a heat-forming step and a mesophase growing and coalescing step, in accordance with respective treatment conditions to produce 100% mesophase composed only of Q.I. and Q.S. components, having constant properties, continuously on a commercial scale.

In the first step, a virgin raw material in a constant amount necessary to produce a 100% mesphase composed only of Q.I. and Q.S. components separated from a mesophase growing and coalescing step is continuously added to the heat-treatment step, and this added raw material, together with the non-mesophase pitch separated from the mesophase growing and coalescing step, is heat-treated. As heat-treatment conditions for causing the mesophase in the heat-formed pitch taken out from the heat-treatment step to be in the range of 10 to 50%, a heating temperature of 360° C.~450° C. under atmospheric or superatmospheric pressure and a stream of a hydrocarbon gas of small numbers of C-atom, or low melting point naphtha fraction or a dry gas formed as a by-product at the time of heat treatment and heat holding time of 30 min. to 30 hours with stirring were employed. Thus, from the raw material added in the heat treatment step, a heat-formed pitch containing a constant amount of mesophase pitch is continuously produced.

In the second step, a heat-formed pitch corresponding to the amount formed from the raw material added continuously to the heat treatment step is taken out continuously from the heat-treatment step, and it is added to the mesophase growing and coalescing step. The added heat-formed pitch is heated to effect aging under a stream of the above-mentioned hydrocarbon gas of small numbers of C-atom or low melting point naphtha fractions or a dry gas formed as a by-product at the time of heat treatment in the mesophase growing and coalescing step (this condition is entirely different from that of heat treatment) and then a clearcut separation of non-mesophase pitch of the upper layer and mesophase pitch of the lower layer is done at the temperature same as the aging melt-coalescing temperature. The heat reaction for producing mesophase and the aging reaction for enlarging produced mesophase are entirely different and, by treating these reactions separately, it is only possible to separate a 100% mesophase and non-mesophase by the different physical properties (such as specific gravity viscosity, etc.) As heat-aging conditions a heating temperature of 280° C. to 350° C. under a stream of a the above-mentioned hydrocarbon gas or the like or an inert gas, heat-maintaining time of 5 hours to 30 hours are employed. By these conditions, mesophase is caused to coalesce into huge one body and a 100% mesophase composed only of Q.I. and Q.S. components having a constant physical properties can be taken out continuously from the lower layer of the mesophase growing and coalescing step by utilizing the difference of specific gravities or other physical properties (e.g. viscosity) at the temperature same as the aging melt coalescing temperature. The amount thereof corresponds to the mesophase formed from the raw material continuously added to heat-treatment step and at the same time, a non-mesophase pitch in an amount corresponding to the balance (of deduction mesophase discharged continuously from the mesophase growing and coalescing step from the heat-formed pitch added to the mesophase growing and coalescing step) is taken out of the upper layer of the mesophase growing and coalescing step and returned to the heat-treatment step in order to carry out the repetition of the heat-stirring treatment, together with a raw material newly added to the heat-treatment step, to produce and taken out continuously a 100% mesophase composed only of Q.I. and Q.S. components having a constant physical properties from the mesophase growing and coalescing step. As for a carrier gas stream used at the time of heat treatment, as well as at the time of separation of heat formed pitch into non-mesophase and mesophase, hydrocarbon of small carbon atom numbers such as methane, ethane, propane, butane or the like, or naphtha fractions having lower boiling points, which are not converted into heavier materials or pitch, can be mentioned. However, the economically most excellent gas is a dry gas which is formed as a by-product at the time of heat-treatment of raw material (mostly a mixture of hydrocarbons of small carbon number.)

The present invention is based upon the following 4 new facts.

1. A fact that a 100% mesophase pitch, composed only of Q.I. and Q.S. components, having constant physical properties can be produced continuously by installing 2 kinds of treating steps consisting of a heat treatment step in which a raw material is heat-treated with stirring and a mesophase growing and coalescing step in which a heat-formed pitch is heated to effect aging at a condition entirely different from that of heat treatment.

2. When a non-mesophase pitch separated from the upper layer of the mesophase growing an coalescing step is mixed with a raw material added to the heat-treatment step and subjected to heat treatment, mesophase particles which are present as mixtures become seeds of reaction to shorten heating time and advance the heat-treatment smoothly at the same time.

3. The mesophase taken out from the lower layer of the mesophase growing and coalescing step is a 100% mesophase having constant physical properties, which is composed only of two mesophase components of Q.I. (quinoline insoluble measured by extraction with quinoline at 80° C.) and Q.S. (quinoline insoluble). (This can be easily confirmed by using a polyarization microscope).

4. At the time of growing and coalescing of mesophase the non-mesophase pitch of the upper layer and the mesophase pitch of the lower layer is clearly divided at the same temperature as aging melt-coalescing temperature.

In addition, gentle stirring is carried out some times in such an extent that the separation of a non-mesophase layer and a mesophase layer is not disturbed, in order to promote the coalescing of mesophase fraction into huge one body.

There are many kinds in petroleum-origin pitch and their physical properties are also extremely complicated. As the condition for heat-treating, the above-mentioned raw material pitch together with the non-mesophase pitch returned from the upper layer of the mesophase growing and coalescing step, in the heat-treatment step, under a stream of a hydrocarbon gas of small numbers of C-atom or the like at atmospheric or superatmosphere pressure, it is so selected that the mesophase content in the heat-formed pitch falls in the range of 20% to 40%, but heating and stirring temperature should be in the range of 380° C. to 440° C. and heating time should be in the range of 1 to 3 hours.

Further, the heat-formed pitch containing 20~40% mesophase is heated to effect aging under a stream of a hydrocarbon gas of small numbers of C-atom at atmospheric or superatmospheric pressure. As an aging condition of mesophase growing and coalescing step, a aging temperature of 300° C. to 340° C. and holding time of 10 to 15 hours should be selected under a stream of a hydrocarbon gas of small numbers of C-atom or the like or an inert gas (This condition is entirely different from that in the heat treatment step), so as to bring the 100% mesophase composed only of Q.I. and Q.S. components taken out continuously from the lower layer of the mesophase growing and coalescing step to be preferably always in the stabilized and constant state. The 100% mesophase composed only of Q.I. and Q.S. components, taken out continuously can be confirmed with a polarization microscope. It is very important that for the reason of separability of non-mesophase of the upper layer from the 100% mesophase of the lower layer after the aging-melt-coalescing step has an intimate connection with the preceding heat-treatment condition in the present invention.

The three inventions entitled "Method for producing mesophase-containing pitch by using carrier gas, U.S. Ser. No. 507,585, "Method for producing mesophase pitch", U.S. Ser. No. 507,584 and "Improved method for producing mesophase pitch", U.S. Ser. No. 507,586 all filed by the inventor of the present application on the same day with the present application, had been utilized in the present invention and the descriptions of these applications are incorporated in the description of the present application by reference. The invention entitled "Method of producing mesophase pitch", U.S. Ser. No. 507,584, provides a 100% mesophase pitch having a softening point of about 209° to about 246° C.

One example for producing carbon fibers by spinning a 100% mesophase is presented as follows.

The fibers obtained by spinning 100% mesophase at a spinning temperature of 320° C. and a viscosity of 50 poise (at the spinning temperature) and a spinning velocity of 100 m/min are subjected to thermosetting (crosslinking) with air at a temperature of 300° C. for 15 minutes, and then subjected to carbonization at a temperature rising velocity of 10° C./min. and at an ultimate temperature of 1400° C. for 15 minutes to produce carbon filament yarns having high strength and high modulus.

The quality of filament yarns of carbon fibers prepared by repeating spinning from a raw material of continuously produced 100% mesophase was perfectly constant and quite fit to spinning.

BRIEF DESCRIPTION OF THE DRAWING

The attached drawing FIG. 1 shows a schematic continuous production apparatus used in Example 1 of the present invention.

Following examples are set forth for the purpose of illustration for those skilled in the art but not for the purpose of limiting the invention in any manner.

EXAMPLE 1

A residuum carbonaceous material which is formed as a by-product in a catalytic cracking process (F.C.C.) of vacuum gas oil was subjected to heat treatment at 400° C. for 2 hours under a stream of methane gas to produce a precursor pitch.

The precursor described in the present specification means a heat formed pitch obtained by passing a hydrocarbon gas of small numbers of C-atom or the like to drive off volatile matters.

The yield of the precursor was 54% and the softening point of the precursor (corresponding to R & S) was 67° C.

By using a continuous production apparatus shown in FIG. 1, 48 kg of the above-mentioned precursor was charged to a heat-treatment vessel 1 (3 is a stirrer) through a raw material charging tube 2 and subjected to stirring and heating treatment under a stream of methane gas at 400° C. for 6 hours to produce 40.8 kg of heat-formed pitch (yield 85.0%) containing 21% mesophase. The resulting heat-formed pitch, as a starting material for continuous production of mesophase, was added to a mesophase growing and coalescing vessel (aging vessel) 7. Thus 1 kg/hr of the above mentioned precursor was added to the heat treatment vessel through a raw material feed tube 2. The newly added precursor, as a starting material, was heated with stirring and held under a stream of methane gas at 400° C. for 1 hour and heat-formed pitch was taken out continuously at a rate of 4.05 kg/hr through a flow-out tube 6 from the heat-treatment vessel to charge it into the mesophase growing and coalescing vessel 7 where it was heated and held at 320° C. for 10 hours to cause mesophase to coalesce into one huge body by aging, and 100% mesophase was continuously taken out at the same temperature as aging melt-coalescing temperature at a rate of 0.85 kg/hr from the bottom a of the mesophase growing and coalescing vessel 1 through a product discharge pipe 9 and; at the same time; a non-mesophase pitch in a amount corresponding to the control obtained by substracting the above-mentioned 0.85 kg/hr of 100% mesophase product from the taken out 4.05 kg/hr of heat formed pitch, was taken out amount of of the non-mesophase layer of the mesophase growing and coalescing vessel 7 and added to the heat-treatment vessel 1 by way of line 8 to produce continuously 0.85 kg/hr of 100% mesophase compose only of Q.I. and Q.S. components having constant properties after stirring and heating treatment in recirculation. The physical properties of resulting mesophase product are as shown in the following table 1. In the drawing, 4, 5, 11 and 10 were methane gas lines.

TABLE 1

| Physical properties of 100% mesophase | | |
|---|---|---|
| Flow test | softening point °C. | 212 |
| | softening point °C. corresponding to R & B | 264 |
| Mesophase distillate fraction . | Q.I. component % | 78.4% |
| | Q.S. component % | 21.8% |

The gas formed as a by-product of heat-treatment was passed through the heat-treatment vessel and the mesophase growing and coalescing vessel as a stream of recycling gas.

What is claimed is:

1. A method for continuously producing 100% mesophase having a softening point of about 209° to about 246° C. composed only of Q.I. Component and Q.S. Component comprising (i) subjecting a petroleum origin pitch to heat treatment with stirring under the atmospheric or superatmospheric pressure and in the presence of a stream of a non-oxidative gas selected from the group consisting of a hydrocarbon of small carbon number, a lower boiling point naphtha fraction and a dry gas by-product of the heat treatment of the raw material petroleum-origin pitch, at a temperature of 360° C. to 450° C. for from 30 minutes to 30 hours so that the mesophase content in the heat-formed pitch is between 5% to 50%, (ii) continuously transferring a predetermined amount of the heat-treated pitch from the heat-treatment step to a mesophase growing and coalescing step, (iii) heating the transferred heat-treated pitch in the mesophase growing and coalescing step to cause only the mesophase to grow and coalesce by aging under the atmospheric or superatmospheric pressure and in the presence or absence of a stream of the non-oxidative gas at a temperature higher than 280° C. and lower than 350° C. for from 5 to 30 hours, so as to separate the heat-treated pitch into an upper layer of a non-mesophase pitch and a lower layer of a mesophase pitch and (iv) continuously removing a 100% mesophase composed of Q.I. component and Q.S. component from the lower layer in the growing and coalescing step; and simultaneously and continuously removing non-mesophase pitch from the upper layer of the growing and coalescing step, in an amount corresponding to a predetermined amount of the heat-formed pitch transferred to the growing and coalescing step minus the amount of 100% mesophase continuously removed, and (v) adding new raw material pitch in an amount necessary to produce the amount of 100% mesophase continuously removed.

* * * * *